US012064027B2

(12) United States Patent
Ross

(10) Patent No.: US 12,064,027 B2
(45) Date of Patent: Aug. 20, 2024

(54) HORTICULTURE BRUSH

(71) Applicant: David Ross, Bend, OR (US)

(72) Inventor: David Ross, Bend, OR (US)

( * ) Notice: Subject to any disclaimer, the term of this patent is extended or adjusted under 35 U.S.C. 154(b) by 103 days.

(21) Appl. No.: 16/478,238

(22) PCT Filed: Jul. 10, 2019

(86) PCT No.: PCT/US2019/041233
§ 371 (c)(1),
(2) Date: Jul. 16, 2019

(87) PCT Pub. No.: WO2020/014383
PCT Pub. Date: Jan. 16, 2020

(65) Prior Publication Data

US 2021/0330066 A1 Oct. 28, 2021

Related U.S. Application Data

(60) Provisional application No. 62/696,039, filed on Jul. 10, 2018.

(51) Int. Cl.

| | |
|---|---|
| ***A46B 9/02*** | (2006.01) |
| ***A46B 5/00*** | (2006.01) |
| ***A46B 5/02*** | (2006.01) |
| ***A46B 7/04*** | (2006.01) |

(52) U.S. Cl.
CPC ..... *A46B 9/028* (2013.01); *A46B 5/0095* (2013.01); *A46B 5/02* (2013.01); *A46B 7/04* (2013.01); *A46B 2200/3073* (2013.01)

(58) Field of Classification Search
CPC ..... A46B 5/02; A46B 5/021; A46B 5/0095; A46B 7/04; A46B 9/02; A46B 9/028; A46B 2200/3073
USPC ..... 15/DIG. 5
See application file for complete search history.

(56) References Cited

U.S. PATENT DOCUMENTS

| | | | | |
|---|---|---|---|---|
| 5,655,249 | A * | 8/1997 | Li | A46B 9/045 15/167.1 |
| 6,073,634 | A * | 6/2000 | Gueret | A45D 40/22 132/218 |
| 8,220,469 | B1 | 7/2012 | Spagnuolo | |
| 2002/0124336 | A1* | 9/2002 | Henrie | A46B 9/02 15/106 |
| 2004/0134002 | A1* | 7/2004 | Zimmer | A61C 17/222 15/28 |
| 2006/0248669 | A1* | 11/2006 | Dovellos | A46B 3/12 15/159.1 |
| 2007/0143945 | A1* | 6/2007 | DiPietro | A46B 5/026 15/188 |
| 2010/0199449 | A1 | 8/2010 | Ho et al. | |
| 2011/0023249 | A1* | 2/2011 | Boucherie | A46B 3/02 15/171 |
| 2012/0054971 | A1 | 3/2012 | Dugan | |
| 2012/0198642 | A1* | 8/2012 | Jossem | A46B 5/0008 15/106 |

(Continued)

*Primary Examiner* — Randall E Chin
(74) *Attorney, Agent, or Firm* — Donn K. Harms

(57) ABSTRACT

A horticulture brush having a handle with a bristle assembly at a distal end. The bristle assembly has a base that is removably engageable with a distal end of the handle. The bristles are planar on both sides and formed in rows with passages between the rows. A central row of bristles on the assembly is sized larger than surrounding rows which forms a blockage in the passages.

19 Claims, 3 Drawing Sheets

(56) References Cited

U.S. PATENT DOCUMENTS

| | | | |
|---|---|---|---|
| 2014/0101881 | A1 | 4/2014 | Chun et al. |
| 2015/0374114 | A1 | 12/2015 | Wilson et al. |
| 2017/0086571 | A1 | 3/2017 | Jaworski |
| 2018/0153292 | A1 | 6/2018 | Dovellos et al. |

* cited by examiner

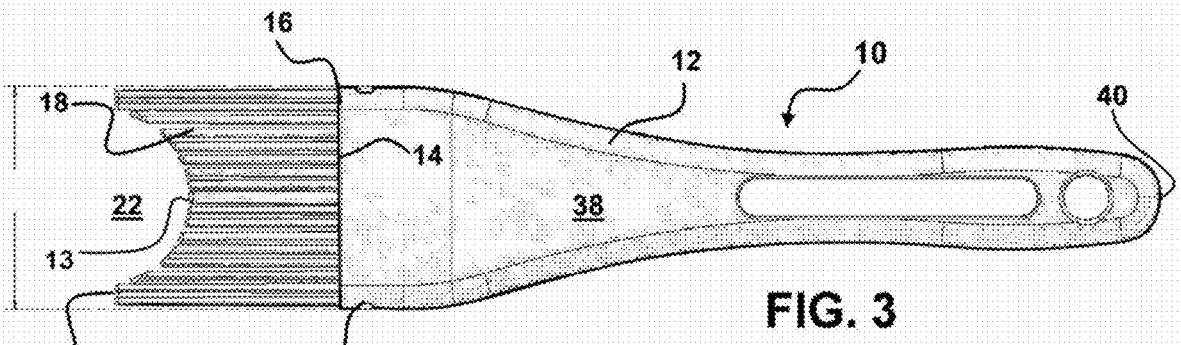
FIG. 3
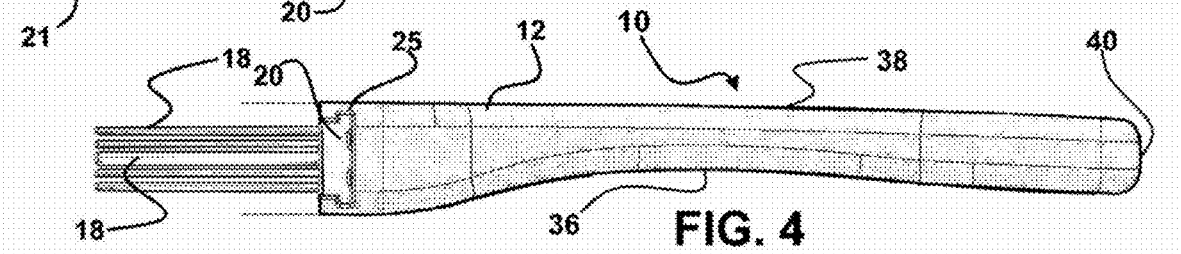
FIG. 4
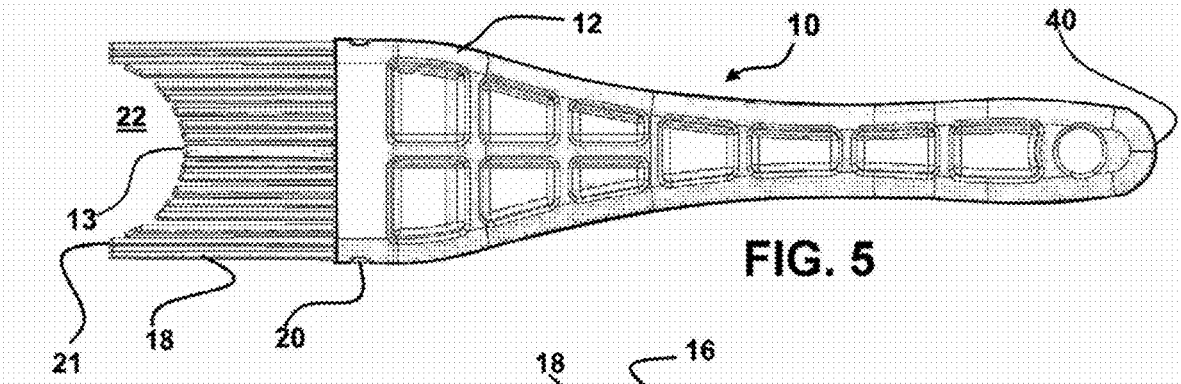
FIG. 5
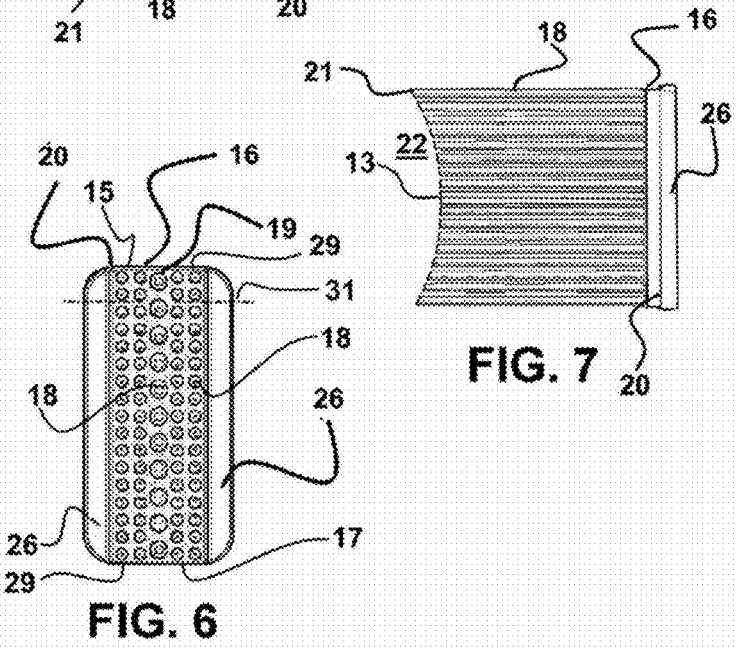
FIG. 6
FIG. 7
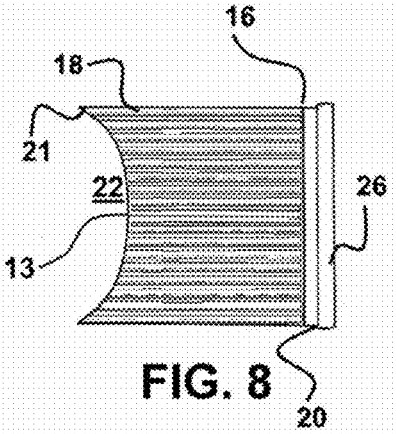
FIG. 8

HORTICULTURE BRUSH

This application claims priority to U.S. Provisional Patent Application Ser. No. 62/696,039, filed on Jul. 10, 2018.

FIELD OF THE INVENTION

The present device relates to horticulture and the growing of flowers and houseplants. More particularly, the disclosed device relates to a soft bristled brush configured for easy cleaning of flower buds and leaves on plants to rid them of insects and other particulate which can inhibit plant growth and the flowering outcome of buds on many such plants.

BACKGROUND OF THE INVENTION

Horticulture and home gardening are very popular in the United States and throughout the world. Especially popular in backyard gardens and commercial enterprises are flowering plants which at a blooming point, produce flowers from buds on the plants. Plants such as roses, gardenias, peonies and many other flowering plants all have flowers which start as buds. In the case of flowering plants such as roses, scale, insects, and other particulate can adhere to the buds prior to flowering and impede or impair the flower produced from the bud. Also, in the case of flowering plants such as *Cannabis* plants, frequently the buds will have dirt and other particulate which becomes affixed to the exterior and crevices of the bud which is not preferable.

Currently, growers of flowering plants which have flowers sprouting from buds, such as roses and the like, will try spraying liquid or powder-dusting the plant and buds to try and remove unwanted scale and particulate. *Cannabis* growers have no real means to try and remove dirt and other particulate from buds on such plants, because liquid will generally harm the bud and dusting is not an option as it simply leaves more particulate which is not wise for a crop which will eventually be ingested.

The device herein is configured with especially soft bristles to allow for brushing of plants and the like to remove particulate and scale and such without harming the plant.

Further, the distal ends of the bristles are configured in lengths to firm a curved surface adapted to evenly brush the exterior of curved or circular buds and the like to remove such scale and particulate.

The forgoing examples of gardening and cleaning of plants and buds thereon, and the limitations related therewith, are intended to be illustrative and not exclusive. The disclosed examples and background does not imply any limitations on the invention described and claimed herein. Various other limitations of the related art in horticulture brushes are known, or such will become apparent to those skilled in the art upon a reading and understanding of the specification below and the accompanying drawings.

SUMMARY OF THE INVENTION

The device and system herein disclosed and described provides a solution to the shortcomings in prior art in the area of horticulture brushes used for removing scale and particulate and even insects from plant exteriors. The brush device herein features a lightweight handle which is configured at the handle's distal end with a plurality of rows of soft bristles engaged with a base.

Further provided, in a preferred mode of the brush device, is a removable engagement at the distal end of the handle, between the bristle assembly and the handle itself. This removable engagement, shown currently as a slot configured for engagement with the exterior of a base of a bristle assembly, allows the user to position any of a plurality of different bristle assemblies onto the distal end of the handle or to simply easily replace a worn bristle assembly with a new one. The bristle assembly has a base as shown herein having side rails adapted for removable sliding engagement into the slot formed into the handle at the distal end of the handle.

The bristle assembly shown herein in various modes may have a curved recess formed into the second ends of the assembled bristles thereby forming a curved recess at the distal end of the bristles of the bristle assembly. The depth and diameter of this recess formed at the distal end of the bristles can vary depending on the intended curved target for the bristles during a cleaning.

For example, a recess forming a longer arc with less depth of the recess at a center point thereof, can be formed to clean curved exteriors of larger buds and the like. Conversely, a recess formed with less depth will form an arc on the distal end of the bristles of the bristle assembly which is adapted to contact against a larger curved surface such as a large bud or even a roundish fruit of the plant being cleaned.

With respect to the above description, before explaining at least one preferred embodiment of the horticulture cleaning brush disclosed and described herein in detail, it is to be understood that the disclosed brush invention is not limited in its application to the details of construction and to the arrangement of the components in the following description or illustrated in the drawings. The brush device herein described and shown is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other brushes and brush like implements for carrying out the several purposes of the present disclosed device. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements. Further, where used the term substantially, unless otherwise defined, means plus or minus ten percent.

It is an object of the present invention to provide a horticulture cleaning brush which is configured with bristles extending to a distal end second end, which forms a curved recess surrounded by the rows of bristles.

It is a further object of the invention to provide such a horticulture cleaning brush which has bristle assemblies of varying curvature and recess depth at the second ends of the bristles and which can be removably engaged to a handle.

It is another object of this invention to provide a handle which is engageable with one or a plurality of brush assemblies from a kit including a plurality thereof, where the formed arc of the recess of each of the brush assemblies is different, to thereby accommodate cleaning of a variety of curved bud and fruit exterior surfaces.

These and other objects, features, and advantages of the disclosed horticulture brush invention, as well as the advantages thereof over existing prior art, which will become apparent from the description to follow, are accomplished by the improvements described in this specification and hereinafter described in the following detailed description, which fully discloses the invention, but should not be considered as placing limitations thereon.

BRIEF DESCRIPTION OF DRAWING FIGURES

The accompanying drawings, which are incorporated herein and form a part of the specification, illustrate some, but not the only or exclusive examples of embodiments and/or features of the disclosed horticulture cleaning brush device. It is intended that the embodiments and figures disclosed herein are to be considered illustrative of the invention herein, rather than limiting in any fashion.

In the drawings:

FIG. 3 shows a top plan view of the brush device of FIG. 1.

FIG. 4 shows a side view of the brush device of FIGS. 1 and 3 and also depicts the base of a brush assembly removably engaged in a slot in the handle.

FIG. 5 depicts a bottom plan view of the brush device opposite the view of FIG. 3.

FIG. 6 depicts an end view of a preferred bristle assembly showing the rows of bristles where a central row of bristles has a diameter wider than rows of bristles on opposing sides.

FIG. 7 depicts a bristle assembly showing the base which is configured for removable engagement with the distal end of the handle of the brush and shows a recess formed by the curve of varied bristle length which is shorter than the recess shown in FIGS. 5 and 8.

FIG. 8 depicts another bristle assembly similar to that of FIG. 7, but showing a deeper recess than that of FIG. 7.

DETAILED DESCRIPTION OF THE INVENTION

Figure 1:
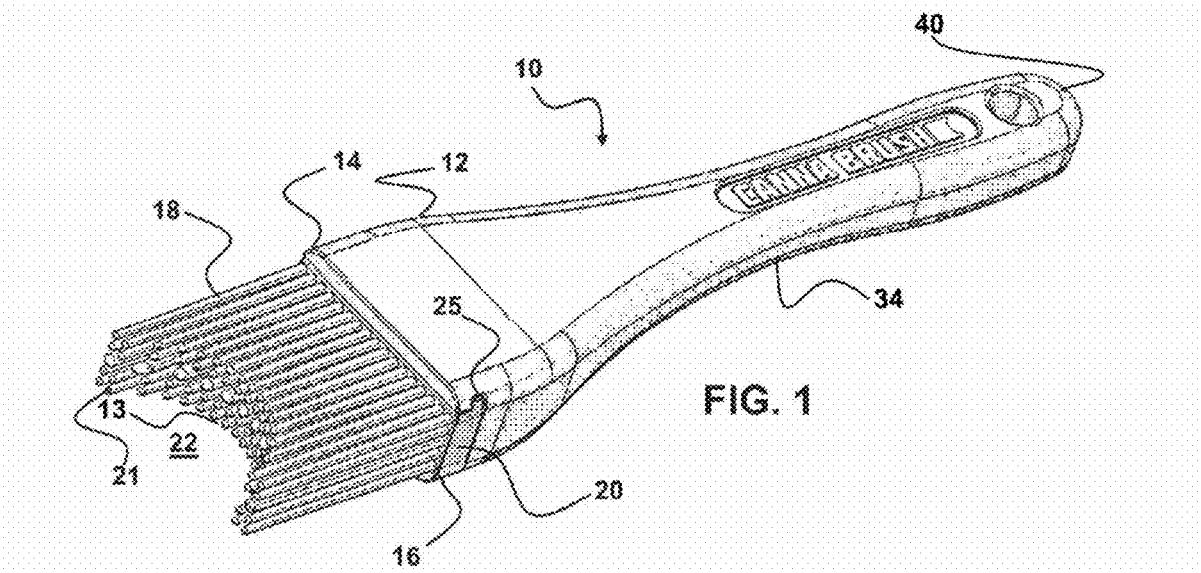
FIG. 1 depicts a perspective view showing the brush device herein having a handle on which a bristle assembly is engaged to the distal end of the handle, where the ends of the bristles in the assembly vary in length to form a curved recess at the distal ends of the bristles.

In this description, the directional prepositions of up, upwardly, down, downwardly, front, back, top, upper, bottom, lower, left, right and other such terms of direction or position, refer to the device as it is oriented and appears in the drawings and are used for convenience only, and such are not intended to be limiting or to imply that the device has to be used or positioned in any particular orientation.

Figure 2:
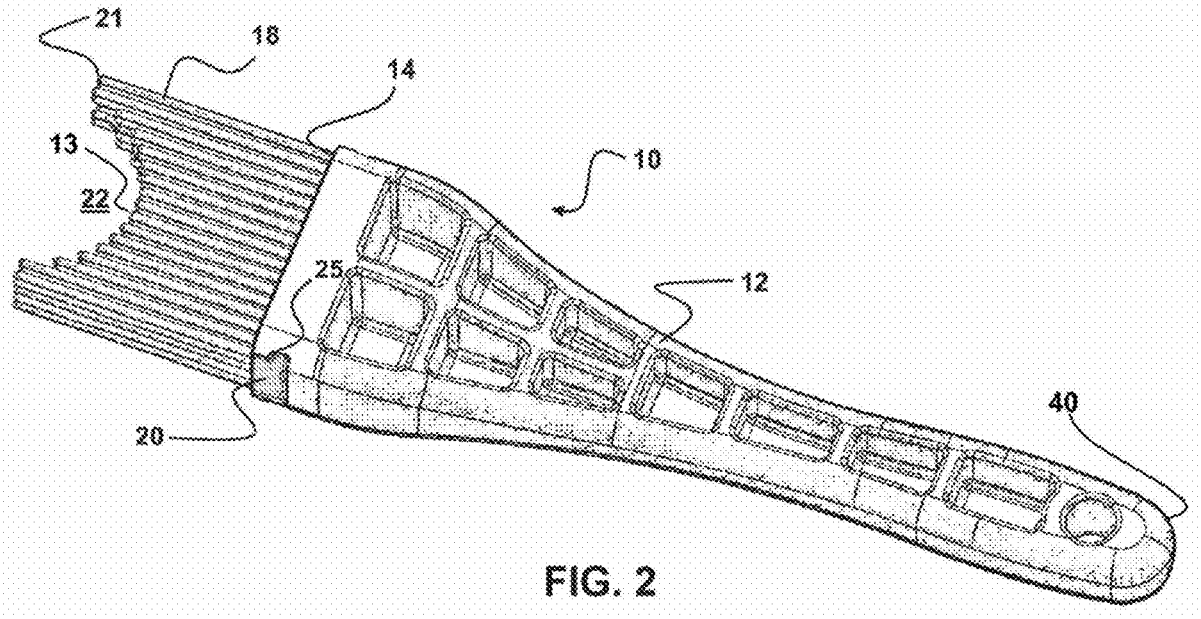
FIG. 2 shows an opposite side perspective view of the device of FIG. 1.

Now referring to drawings in FIGS. 1-13 wherein similar components are identified by like reference numerals, there can be seen in the opposing perspective views of FIGS. 1-2, the brush device 10 herein having a handle 12 having a first end for gripping and having a distal end 14 which a bristle assembly 16 engages in a removable engagement. While the bristle assembly 16 may be engaged permanently, the removable engagement herein is preferred to allow a user to change the bristle assembly 16 and its curve and depth, and its bristle size and shape, or to replace it when worn.

As can be seen in all the figures, the bristle assembly 16 is formed of a plurality of elongated soft bristles 18 which, as can be seen in FIG. 6, are engaged to a base 20 and extend in aligned rows from a first end 15 to a second end 17 of the base 20. Each bristle 18 extends a length from an engagement to the base 20 to a distal or second end 21 of each bristle 18.

As shown herein, in a particularly preferred mode of the device 10, the length of the bristles 18 in their respective positions in respective rows on the base 20 varies. In this fashion in between a first row of bristles 18 at a first end 15 of the base 20 and a last row of bristles 18 at an opposite second end 17 of the base 20, a curved recess 22 is formed. This curved recess 22 at the end of the plurality of bristles 18 in the bristle assembly 16 forms an arc shape which depends into the plurality of bristles 18 from an apex 13 which is the deepest point in a central area of the bristles 18, to a highest point at respective second ends 21 of the bristles 18 at the first end 15 and second end 17 of the base 20.

Changing the depth of the apex 13, changes the shape of the curved recess 22, and one mode of the device 10 can include a kit of bristle assemblies 16. The kit would include kit members, for example each assembly 16 shown in FIGS. 7, 8, and 11. Such provides the user with the ability to engage any member of the kit to clean buds and plants as needed and adjust the arc of the curved area used by changing to the assembly 16 having the desired shape and apex 13.

This curved recess 22, as noted, works especially well to use the device 10 to contact the second ends 21 of the bristles 18 in the bristle assembly 16 frictionally against a larger area of a curved surface of a bulb or fruit or other curved area of a plant. As also noted herein, the removable engagement between the bristle assembly 16 and the distal end 14 of the handle 12, allows for other bristle assemblies 16 to be engaged which may have a curved recess 22 of a different depth, arc, or shape to be engaged, to allow a user the ability to position a bristle assembly 16 on the brush handle 12 which has a curved recess 22 in an arc matching that of the bud or flower or plant.

Shown in FIGS. 3 and 5 in the top plan view and opposite bottom plan view of the brush device 10 of FIGS. 1-2, is the depth, width, and arc or curve of the curved recess 22. As noted, this curved recess 22 is formed by the varying lengths of the individual bristles 18 in the bristle assembly 16 which is engaged to the distal end 14 of the handle 12. As shown in FIG. 6, the bristles 18 of the bristle assembly 16 are positioned sequentially in rows, and varying the lengths thereof can allow for the formation of a curved recess 22 of any apex 13 forming an arc or curve needed for easy contact with curved surfaces encountered on a plant.

As can be seen in FIG. 4 in the side view of the device 10, the base 20 of the bristle assembly 16 is preferably configured for a removable engagement with the handle 12. As shown in FIG. 4 and various figures herein such as FIG. 9, a preferred mode of removable engagement is forming the base 20 in a configuration to slide into a complimentary shaped slot 25 formed into the distal end 14 of the handle. Particularly preferred for stability of the base 20 is forming the base with side rails 26 which engage within the complimentary shaped rail slots 27 formed on opposing sides of the slot 25. It was found that such a configuration makes it easier for the user to engage the base 20 in the slot 25, and that the increased surface area on the exterior of the base 20 provided by the projecting side rails 26, provided for a more stable non moving mount therein.

Figure 12:
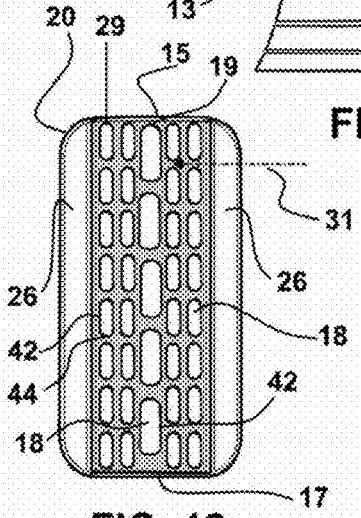
FIG. 12 depicts a brush assembly employing the planar bristles of FIG. 11 and also having a central row of enlarged planar bristles.

As noted herein, FIG. 6 depicts an end view of a bristle assembly 20 showing the aligned rows 29 of bristles 18 which vary in length to form the curved recess 22. Also shown in FIG. 6 and FIG. 12 is a preferred central row 19 of bristles 18 which have a diameter or width larger than the adjacent rows of bristles 18 on opposing sides. By larger is meant between 1.25 to 2.5 times the width of the adjacent bristles 18. It has been found in experimentation that forming the central row 19 of bristles 18 wider than those of adjacent rows 29, provides for better removal of particulate and the like from the bud or curved plant surface being cleaned by the device 10 herein, and such is preferred. Experimentation has shown that this configuration positions the larger bristles in the central row 19 in positions to block the aligned passages 31 running between the rows 29 of adjacent bristles 18. Such allowed the device 10 herein, even without the curved recess 22, to better clean debris, insects and other materials from buds and plants. The larger width or diameter bristles 18 in the central row 19, serve to block the passages 31 only in this central row 19 area with stiffer bristles 18 in this larger configuration, whereupon it was found that debris and unwanted matter on a bud being cleaned, was collected and held.

As such, the inclusion of this central row 19, with the bristles 18 therein formed between 1.25-2.5 times the width or diameter of the bristles 18 in the adjacent rows 29 is preferred in all modes of the device 10 herein, either with or without the curved recess 22 included. This configuration, as shown in FIG. 6 and FIG. 9 and in adaptations thereto, provides enhanced cleaning during use.

Shown in FIGS. 7-8 both are a bristle assembly 16 showing the base 20 which is configured for removable engagement with the slot 25 in the distal end 14 of the handle 12 of the brush device 10. As noted, the curved recess 22 may vary in size, depth, curvature and width, to form a highly customizably shaped curved recess 22. The depicted individual curved recesses 22 in FIGS. 7-8 and 11, and elsewhere herein, should in no fashion be considered limiting as many other shapes and sizes of such curved recesses 22 can be formed by varying bristle length in the bristle assembly 16.

Figure 9:
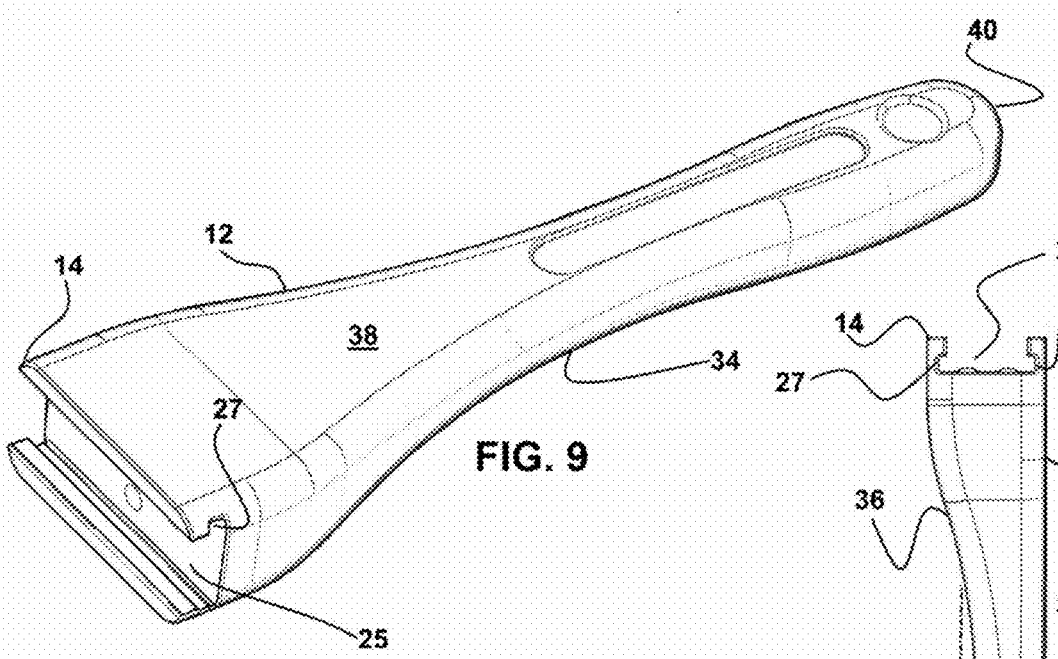
FIG. 9 depicts the handle with the brush assembly disengaged from the slot and showing the slot configured with opposing recesses adapted to engage with the side rails of the removably brush assemblies.

FIG. 9 depicts the handle 12 with the bristle assembly 16 disengaged from the slot 25. As shown, the slot 25 includes rail slots 27 on opposing sides of the slot 25 which are complimentary in shape and size to the side rails 26 on the base 20 of the bristle assembly 16.

Figure 10:
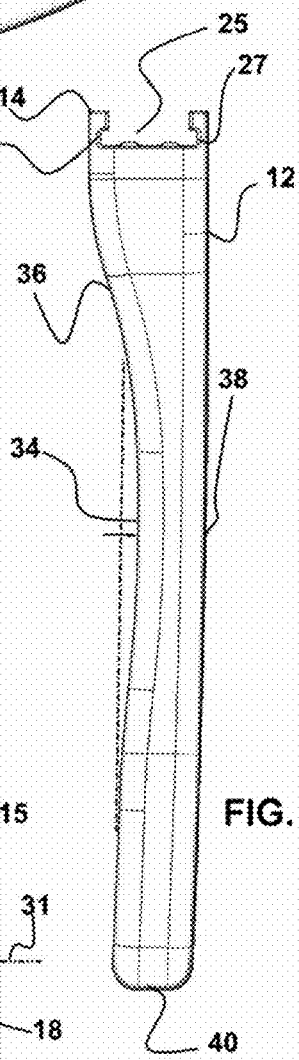
FIG. 10 shows the handle of FIG. 9, from a side view which shows the curved second side opposite the planar first side where the curve defines a finger accommodating indent on the second side.

FIG. 10 shows the handle of FIGS. 4 and 9, from a side view which provides another view of the slot 25 having the preferred rail slots 27. Also shown are a handle recess 34 formed into a second side 36 of the handle 12 opposite a substantially planar first side 38. This handle recess 34 in between the distal end 14 and first end 40 of the handle 12, were found in experimentation to form a finger accommodating indent on the second side 34 of the handle 12 which made it both easier and more comfortable for the user to hold the handle 12 during use.

FIG. 12 shows a bristle assembly 16 employing a plurality of rows 29 of bristles 18 where each is formed having opposing planar side surfaces 42 in between opposing edges 44 which are shown curved. It was found in experimentation that the planar side surfaces 42 of the bristles which run substantially parallel to the rails 26 or sides of the base 20, provided significantly better results in removing debris and dirt and insects and the like when used. Using bristles 18 formed of silicone with the elongated side surfaces, significantly more unwanted material was removed. As such, bristles 18 formed of soft material such as silicone, with planar sides, with and without the enhancing curved recess 22 are a particularly preferred mode of the device 10.

Figure 11:
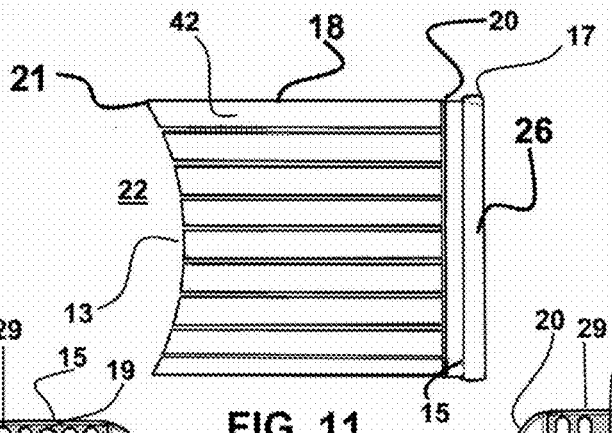
FIG. 11 shows a brush assembly employing a plurality of rows of bristles having opposing planar side surfaces and opposing curved edges therebetween.

FIG. 12 depicts a bristle assembly 16 employing the planar bristles of FIG. 11 and also having a central row 19 of enlarged planar configured bristles 18. As noted above, forming the bristles 18 in this central row 19 between substantially 1.25 to 2.5 times larger than the size of the adjacent bristles 18 in the adjacent rows 29 enhances cleaning during use. This configuration, as with that of FIG. 6, positions the larger central row 19 bristles 18 in position to block the passages 31 running between the rows 29 of bristles 18 located on both sides of the central row 19. As noted, this blockage enhances debris and insect removal during use.

Figure 13:
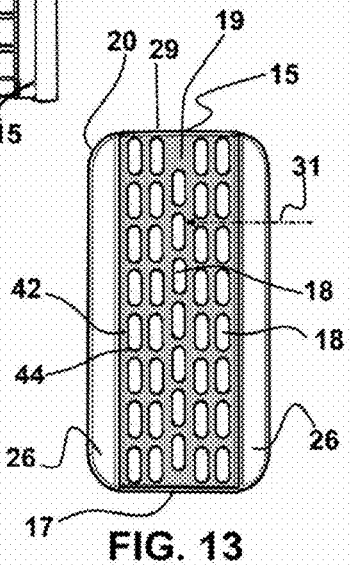
FIG. 13 depicts a brush assembly having planar bristles such as in FIG. 11, but having the central row misaligned with adjacent rows where the central row blocks passages running between the exterior located bristles.

FIG. 13 shows a bristle assembly 16 having planar side surfaces 42 on the bristles 18 such as in FIG. 11, but having the central row 19 of the same size but misaligned with adjacent rows 29 of bristles on opposing sides thereof. This configuration, while not quite as effective as the enlarged planar bristles 18 in the central row 19 of FIG. 12, worked better than formations where all the bristles 18 are aligned to form unblocked passages 31 therebetween. As such placing bristles 18 in the central row 19 in positions to block the passages 31 in between adjacent rows 29 of bristles is another preferred configuration yielding enhanced function.

It should be noted that any of the different depicted and described configurations and bristle assemblies of the brush device herein can be employed with any other configuration or component shown and described as part of the device herein. Additionally, while the present invention has been described herein with reference to particular embodiments thereof and steps in the method of production, a latitude of modifications, various changes and substitutions are intended in the foregoing disclosures, it will be appreciated that in some instance some features, or configurations, of the invention could be employed without a corresponding use of other features without departing from the scope of the invention as set forth in the following claims. All such changes, alternations and modifications as would occur to those skilled in the art are considered to be within the scope of this invention as broadly defined in the appended claims.

What is claimed is:

1. A horticulture brush configured for a sliding contact cleaning the exterior surface of plant buds comprising:

a handle having a first end opposite a distal end;

said handle having a first side surface extending between said first end and said distal end thereof, opposite a second side surface;

a bristle assembly positioned at said distal end;

said bristle assembly having a plurality of bristles engaged therewith, each of said bristles extending from attachments at a first end thereof to said bristle assembly, to respective distal ends thereof;

said bristles arranged in rows extending from a first end of said bristle assembly to a second end thereof;

said bristle assembly having a first side and a second side extending in between said first end and said second end thereof;

passages communicating in between said bristles in said rows, said passages running between said first side and said second side of said bristle assembly;

said bristles having a smooth continuous first side surface extending from said first end thereof to said distal end thereof and between a first side edge and a second side edge of said bristles;

said bristles having a smooth continuous second side surface extending from said first end thereof to said distal end thereof and between said first side edge and said second side edge;

each said first side surface being planar; and each said second side surface being planar and running substantially parallel to said first side surface thereby forming smooth parallel sliding contact surfaces upon said first side surfaces and said second side surfaces for sliding contact against the exterior of plant buds to clean particulate therefrom without imparting damage thereto during said sliding contact.

2. The horticulture brush of claim 1, further comprising:

said bristles formed in lengths extending between respective said attachments to said bristle assembly to distal ends thereof which define an arch shape at said distal ends of said plurality of bristles; and said arch shape having an apex in a central area of said plurality of bristles located in a central area of said bristle assembly positioned in between said first end and said second end of said bristle assembly.

3. The horticulture brush of claim 2, further comprising:

said bristle assembly having a base;

said first end of said bristle assembly located at a first end of said base;

said second end of said bristle assembly located at a second end of said base opposite said first end thereof;

said first side and said second side of said bristle assembly extending along opposing sides of said base in between said first end of said base and said second end of said base; and said base being removably engageable with a slot formed at said distal end of said handle.

4. The horticulture brush of claim 3, further comprising:

a central row of said bristles positioned in between said rows of bristles, said central row extending in between said first end of said bristle assembly and said second end of said bristle assembly; and said bristles located in said central row positioned to block said passages running between said first side and said second side of said bristle assembly.

5. The horticulture brush of claim 4, further comprising:

said bristles located in said central row having a central length of both said first side surface and said second side surface thereof, said central length being between 1.25-2.5 times a bristle side length of said first side surface and said second side surface of the other of said plurality of bristles.

6. The horticulture brush of claim 5, further comprising:

side rails extending from both of said opposing sides of said base in between said first end of said base and said second end of said base;

rail slots formed in said slot at said distal end of said handle; and said rails engaging said rail slots.

7. The horticulture brush of claim 2, further comprising:

a central row of said bristles positioned in between said rows of bristles, said central row extending in between said first end of said bristle assembly and said second end of said bristle assembly; and said bristles located in said central row positioned to block said passages running between said first side and said second side of said bristle assembly.

8. The horticulture brush of claim 7, further comprising:

said bristles located in said central row having a central length of both said first side surface and said second side surface thereof, said central length being between 1.25-2.5 times a bristle side length of said first side surface and said second side surface of the other of said plurality of bristles.

9. The horticulture brush of claim 3, further comprising:

side rails extending from both of said opposing sides of said base in between said first end of said base and said second end of said base;

rail slots formed in said slot at said distal end of said handle; and said rails engaging said rail slots.

10. The horticulture brush of claim 4, further comprising:

side rails extending from both of said opposing sides of said base in between said first end of said base and said second end of said base;

rail slots formed in said slot at said distal end of said handle; and said rails engaging said rail slots.

11. The horticulture brush of claim 1, further comprising:

said bristle assembly having a base;

said first end of said bristle assembly located at a first end of said base;

said second end of said bristle assembly located at a second end of said base opposite said first end thereof;

said first side and said second side of said bristle assembly extending along opposing sides of said base in between said first end of said base and said second end of said base; and said base being removably engageable with a slot formed at said distal end of said handle.

12. The horticulture brush of claim 11, further comprising:

a central row of said bristles positioned in between said rows of bristles, said central row extending in between said first end of said bristle assembly and said second end of said bristle assembly; and said bristles located in said central row positioned to block said passages running between said first side and said second side of said bristle assembly.

13. The horticulture brush of claim 12, further comprising:

said bristles located in said central row having a central length of both said first side surface and said second side surface thereof, said central length being between 1.25-2.5 times a bristle side length of said first side surface and said second side surface of the other of said plurality of bristles.

14. The horticulture brush of claim 13, further comprising:

side rails extending from both of said opposing sides of said base in between said first end of said base and said second end of said base;

rail slots formed in said slot at said distal end of said handle; and said rails engaging said rail slots.

15. The horticulture brush of claim 11, further comprising:

side rails extending from both of said opposing sides of said base in between said first end of said base and said second end of said base;

rail slots formed in said slot at said distal end of said handle; and said rails engaging said rail slots.

16. The horticulture brush of claim 12, further comprising:

side rails extending from both of said opposing sides of said base in between said first end of said base and said second end of said base;

rail slots formed in said slot at said distal end of said handle; and said rails engaging said rail slots.

17. The horticulture brush of claim 1, further comprising:

a central row of said bristles positioned in between said rows of bristles, said central row extending in between said first end of said bristle assembly and said second end of said bristle assembly; and said bristles located in said central row positioned to block said passages running between said first side and said second side of said bristle assembly.

18. The horticulture brush of claim 17, further comprising:

said bristles located in said central row having a central length of both said first side surface and said second side surface thereof, said central length being between 1.25-2.5 times a bristle side length of said first side surface and said second side surface of the other of said plurality of bristles.

19. The horticulture brush of claim 1, further comprising:

each of said distal ends of said bristles having a continuous smooth surface thereon for contact thereof with a plant bud.

* * * * *